US008316509B1

(12) United States Patent
Thomson et al.

(10) Patent No.: US 8,316,509 B1
(45) Date of Patent: Nov. 27, 2012

(54) COMBINATION CLOSURE CAP AND CARRYING HANDLE USEABLE ON BEVERAGE BOTTLES AND THE LIKE

(76) Inventors: Donald W. Thomson, Okotoks (CA); Randell N. Smith, Glenwood Springs, CO (US); Jorald W. Olp, Sr., Glenwood Springs, CO (US)

( * ) Notice: Subject to any disclaimer, the term of this patent is extended or adjusted under 35 U.S.C. 154(b) by 0 days.

(21) Appl. No.: 13/200,543

(22) Filed: Sep. 23, 2011

(51) Int. Cl.
*A45C 13/26* (2006.01)

(52) U.S. Cl. ..... 16/422; 16/425; 16/443; 16/436; 16/110.1; 220/756; 220/759; 215/396; 222/465.1; 294/27.1

(58) Field of Classification Search ..... 16/422, 16/425, 426, 436, 443, 110.1, DIG. 25, DIG. 41; 294/27.1, 28, 29, 30, 31.1, 31.2, 90; 220/756, 220/764, 759, 769, 758, 772, 768; 215/252, 215/258, 329, 328, 396, 397, 399; 222/465.1, 222/467, 470, 475, 475.1
See application file for complete search history.

(56) References Cited

U.S. PATENT DOCUMENTS

| | | | | |
|---|---|---|---|---|
| 822,567 | A | 6/1906 | Williams | |
| 1,339,033 | A | 5/1920 | Martin | |
| 2,434,787 | A | 1/1948 | Budan | |
| 3,016,221 | A * | 1/1962 | Underwood | 248/102 |
| 3,963,206 | A * | 6/1976 | Scolaro et al. | 248/105 |
| 3,990,596 | A * | 11/1976 | Hoftman | 215/11.1 |
| 4,177,906 | A | 12/1979 | Von Hagel | |
| 4,305,516 | A | 12/1981 | Perne et al. | |
| 4,373,632 | A * | 2/1983 | VanZandt | 206/457 |
| 4,373,640 | A * | 2/1983 | Resio | 215/228 |
| 4,579,237 | A * | 4/1986 | Gagnon | 215/396 |
| 4,865,208 | A * | 9/1989 | Lax et al. | 215/396 |
| 4,936,614 | A * | 6/1990 | Russell | 294/27.1 |
| 5,004,415 | A | 4/1991 | Schulz et al. | |
| 5,282,541 | A | 2/1994 | Chen | |
| 5,301,858 | A | 4/1994 | Hollander | |
| 5,305,900 | A | 4/1994 | Maguire et al. | |
| 5,675,954 | A | 10/1997 | Garcia | |
| 6,120,838 | A | 9/2000 | Zickell | |
| 6,228,503 | B1 | 5/2001 | Zickell | |
| 6,352,235 | B2 * | 3/2002 | Cizek | 248/692 |
| 6,706,366 | B2 | 3/2004 | Meyer et al. | |
| 7,062,882 | B2 | 6/2006 | Porat | |
| D533,057 | S * | 12/2006 | Rabe | D9/435 |
| 7,607,592 | B1 | 10/2009 | Kim | |

(Continued)

FOREIGN PATENT DOCUMENTS

DE 19536309 A1 * 4/1997

(Continued)

*Primary Examiner* — Chuck Y. Mah
(74) *Attorney, Agent, or Firm* — Richard L. Miller

(57) ABSTRACT

A multi-function carrying handle and suspender either for engaging a cap and a shoulder of a bottle simultaneously in such a manner so as to better distribute carrying load so as to avoid puncturing the shoulder of the bottle when being carried or for facilitating turning the cap of the bottle or for suspending a suspendable article, which includes a body, an arm, and fingers. The body has a through bore engaging the cap of the bottle when used to carry the bottle or when used to facilitate turning the cap of the bottle. The arm extends arcuately outwardly from the body to a terminal end, and carries the bottle when used to carry the bottle or facilitate turning the cap of the bottle when used to facilitate turning the cap of the bottle.

13 Claims, 8 Drawing Sheets

U.S. PATENT DOCUMENTS

| | | | | |
|---|---|---|---|---|
| 8,047,387 | B2 * | 11/2011 | Chalekian et al. | 215/305 |
| 2001/0022055 | A1 | 9/2001 | Zhang | |
| 2002/0066758 | A1 * | 6/2002 | Fadal et al. | 224/148.7 |
| 2004/0050815 | A1 | 3/2004 | Blanchester | |
| 2005/0198917 | A1 | 9/2005 | Hokkirigawa et al. | |
| 2006/0266406 | A1 | 11/2006 | Faust et al. | |
| 2008/0023434 | A1 * | 1/2008 | Takayama | 215/396 |

FOREIGN PATENT DOCUMENTS

| | | | |
|---|---|---|---|
| EP | 670269 | A1 * | 9/1995 |
| GB | 2435460 | A * | 8/2007 |

* cited by examiner

COMBINATION CLOSURE CAP AND CARRYING HANDLE USEABLE ON BEVERAGE BOTTLES AND THE LIKE

1. BACKGROUND OF THE INVENTION

A. Field of the Invention.

The embodiments of the present invention relate to a bottle cap, and more particularly, the embodiments of the present invention relate to a multi-function carrying handle and suspender either for engaging a cap and a shoulder of a bottle simultaneously in such a manner so as to better distribute carrying load so as to avoid puncturing the shoulder of the bottle when being carried or for facilitating turning the cap of the bottle or for suspending a suspendable article.

B. Description of the Prior Art.

Numerous innovations for bottle cap/bottle/cap accessories, and roof tiles and asphalt have been provided in the prior art, which will be described below in chronological order to show advancement in the art, and which are incorporated herein by reference thereto. Even though these innovations may be suitable for the specific individual purposes to which they address, nevertheless, they differ from the present invention in that they do not teach a multi-function carrying handle and suspender either for engaging a cap and a shoulder of a bottle simultaneously in such a manner so as to better distribute carrying load so as to avoid puncturing the shoulder of the bottle when being carried or for facilitating turning the cap of the bottle or for suspending a suspendable article.

(1) U.S. Pat. No. 822,567 to Williams.

U.S. Pat. No. 822,567 issued to Williams on Jun. 5, 1906 teaches a bottle or jar closure including a cap having yielding sides, a split ring encircling the sides, and a lever having a cylindrical head to which the ends of the ring are connected.

(2) U.S. Pat. No. 1,339,033 to Martin

U.S. Pat. No. 1,339,033 issued to Martin on May 4, 1920 teaches a roofing structure including a plurality of tiles arranged in courses. Each tile is provided near one edge thereof with a groove that increases in width downwardly, and at its opposite edges thereof, with an upwardly bulging flange projecting laterally beyond the same. The flange has a depending rib spaced from the edges thereof. The rib increases in width downwardly. The rib of one tile is adapted for insertion within the groove of an adjacent tile. Plastic material within the groove anchors the rib therein. Each tile is provided at is upper end with a transverse recess having its top open. The top is covered by the lower end of the adjacent tile in the upper course. Plastic material within the transverse recess binds the tiles together. Each tile is further provided centrally thereof upon its lower surface with a groove to receive the flange whereby the tiles in the different courses are arranged to break joint.

(3) U.S. Pat. No. 2,434,787 to Budan.

U.S. Pat. No. 2,434,787 issued to Budan on Jan. 20, 1948 in U.S. class 215 and subclass 38 teaches a cap including a central area surrounded by a circular seat portion, a circular flange extending downwardly from the outer edge of the seat portion, and two diametrically opposite spring ears. Each spring ear has side edges. The ears extend downwardly from the flange. At least of the ears has in one of its sides edges an arcuate recess that produces a hook with a point suited to hooking onto the finger-hold flap of a conventional milk bottle cap. The point is directed toward the aforesaid circular flange. The ear has also a central downwardly directed point portion to indent or puncture a conventional milk bottle cap. The latter portion affords an anchored fulcrum point for use in prying off the conventional cap when the aforesaid hook is applied under the finger-hold flap thereof. The ear which carries the downwardly directed point portion is widened superjacent to the downwardly directed point portion thus affording stop shoulders that prevent more than a slight penetration of the cap by the latter point portion when used as a fulcrum as aforesaid.

(4) U.S. Pat. No. 4,177,906 to Von Hagel.

U.S. Pat. No. 4,177,906 issued to Von Hagel on Dec. 11, 1979 in U.S. class 215 and subclass 252 teaches a milk bottle having an antitamper cap having a plug adapted to fit into the mouth of the bottle. The neck of the bottle is tapered toward the mouth and the cap has apparatus for restraining the top of the neck to keep the mouth in good sealing contact with the plug when the cap is screwed on.

(5) U.S. Pat. No. 4,305,516 to Perne et al.

U.S. Pat. No. 4,305,516 issued to Perne et al. on Dec. 15, 1981 in U.S. class 215 and subclass 252 teaches a cap provided with a guarantee strip for stoppering receptacles with a threaded neck. The guarantee strip is formed by at least two separate elements connected to the base of the skirt of the cap by two bosses, of which one, is located ahead of the other as the cap is screwed on and is more resistant than the other The one boss is severed when the cap is unscrewed.

(6) U.S. Pat. No. 5,004,415 to Schulz et al.

U.S. Pat. No. 5,004,415 issued to Schulz et al. on Apr. 2, 1991 in U.S. class 425 and subclass 297 teaches production of concrete roof tiles in an extrusion process, in which a continuous layer of fresh concrete is deposited on pallets supplied in a continuous row to a depositing apparatus and is subsequently compacted by way of a shaping roller and slipper and, if appropriate, profiled, and then the compacted layer of fresh concrete is cut at a cutting station into roof-tile moldings of equal length with a rear edge and a front edge, and the front edge is trimmed. To increase the weathering resistance and the strength of the front edge of the concrete roof tiles produced in this way, and to reduce the efflorescence that occurs in this region, a rounding or bevel starting from the lower cut edge adjacent to the pallet and extending up to the top side of the roof-tile moldings is produced, preferably in steps, on the front edge as a result of a compacting of material. The apparatus provided for this purpose has, as a trimming tool, an indentation tool that matches the profile of the layer of fresh concrete and which, during its movement penetrating into the layer of fresh concrete, compacts the front edge portion produced in the preceding work cycle over the entire cross-section of the latter.

(7) U.S. Pat. No. 5,282,541 to Chen.

U.S. Pat. No. 5,282,541 issued to Chen on Feb. 1, 1994 in U.S. class 215 and subclass 229 teaches a cap locking device for a water bottle, which includes a bottle cap threadably closing an inner bottle, and a push button and a nipple pusher. The bottle cap is shaped like a shell head having a diametric opening. A tubular post in the opening for a nipple fixed on top of a drinking tube extends vertically in the inner bottle to fit therein, and a push button is pivotally fitted in one side portion of the opening and the liftable nipple pusher is pivotally fitted in another side portion of the opening. The liftable nipple pusher is pushed down to close the opening or raised up to open the opening by pushing the push button for the nipple exposed for sucking the content of the inner bottle contained in an outer bottle.

(8) U.S. Pat. No. 5,301,858 to Hollander.

U.S. Pat. No. 5,301,858 issued to Hollander on Apr. 12, 1994 in U.S. class 224 and subclass 148.2 teaches a recreational water bottle system including a primary vessel for holding liquids, a watertight cap having a bottle tube extending therethrough into the primary vessel, a drinking tube for delivering liquids to a user, and an oversleeve adapter disposed between the bottle tube and the drinking tube for passing liquids and for selectively holding the bottle tube and the drinking tube in structural alignment. The system is adapted to be selectively mounted onto the frame of a bicycle or onto the body of an athlete, or used as a hand held sport bottle.

(9) U.S. Pat. No. 5,305,900 to Maguire et al.

U.S. Pat. No. 5,305,900 issued to Maguire et al. on Apr. 26, 1994 in U.S. class 215 and subclass 245 teaches a bottle cap device formed so as to have a positive sealing arrangement for use with bottles that store gaseous fluid, such as soda water and like beverages. The bottle cap device includes a threaded cap body and a hinged cover or lid that is formed having a sealing annular structure that compresses an annular gasket against the mouth of the bottle by a depending convex wall that engages a gasket mounted when the cover is locked in a close sealed position and a pressure release latch for limiting the movement of the hinged cover after it is unlocked from the cap body to relieve pressure within the bottle.

(10) U.S. Pat. No. 5,675,954 to Garcia.

U.S. Pat. No. 5,675,954 issued to Garcia on Oct. 14, 1997 in U.S. class 52 and subclass 518 teaches a tile obtained from recycling worn rubber tires of automobiles. The tire is chopped into lengths of about 10" to 16" and then about 4" is lopped off the two side rim parts. The outer surface of the remaining central rolling tread part is run down to make it smooth and even, and the tile is heated to between 210° and 300° F. for about one-half hour to straighten the longitudinal curvature. The cross curvature is maintained for a colonial type tile aspect.

(11) U.S. Pat. No. 6,120,838 to Zickell.

U.S. Pat. No. 6,120,838 issued to Zickell on Sep. 19, 2000 in U.S. class 427 and subclass 186 teaches a recycled asphalt roofing material for use on sloped roofs, which provides the required elevated melt point without using methods of oxidizing the asphalt prior to incorporation into the roofing material. The recycled asphalt roofing material is made up of approximately 30% flux asphalt and approximately 70% reclaimed asphalt roofing material. The fibrous backing in the reclaimed material modifies the asphalt in such a way as to provide the required elevated melt point. The manufacturing process for recycled fiberglass mat-based roll and shingle roofing, in its preferred embodiment, consists of impregnating a roofing material backbone, such as a fiberglass or polyester mat, with recycled asphalt material to form inner and outer layers of recycled material, and then applying optional second inner and outer layers of standard asphalt coating to the inner and outer layers of the recycled material. The second coating encapsulates and seals the recycled material.

(12) U.S. Pat. No. 6,228,503 to Zickell.

U.S. Pat. No. 6,228,503 issued to Zickell on May 8, 2001 in U.S. class 428 and subclass 489 teaches a recycled asphalt roofing material for use on sloped roofs, which provides the required elevated melt point without using methods of oxidizing the asphalt prior to incorporation into the roofing material. The recycled asphalt roofing material is made up of approximately 30% flux asphalt and approximately 70% reclaimed asphalt roofing material. The fibrous backing in the reclaimed material modifies the asphalt in such a way as to provide the required elevated melt point. The manufacturing process for recycled fiberglass mat-based roll and shingle roofing, in its preferred embodiment, consists of impregnating a roofing material backbone, such as a fiberglass or polyester mat, with recycled asphalt material to form inner and outer layers of recycled material, and then applying optional second inner and outer layers of standard asphalt coating to the inner and outer layers of the recycled material. The second coating encapsulates and seals the recycled material.

(13) United States Patent Application Publication Number 2001/0022055 to Zhang.

United States Patent Application Publication Number 2001/0022055 published to Zhang on Sep. 20, 2001 in U.S. class 52 and subclass 309.1 teaches a shaped plastic roof tile, preferably, one shaped like a slate tile. The tile is constructed of the combination of a thermoplastic, preferably, one or more polyolefin polymers, and a chlorine-containing polymer in an amount to provide a final chlorine content to the tile of between 1% and 65% by weight. The polyolefin polymer is, preferably, a combination of polyethylene and polypropylene derived from recycled material. The chlorine-containing polymer is one or more polymers selected from the group consisting of polyvinyl chloride (PVC), chlorinated polyvinyl chloride (CPVC), polyvinylidene dichloride (PVDC), chlorinated polyolefin, acrylate modified PVC, neoprene rubber, copolymers of vinyl chloride with ethylene, propylene, vinyl acetate, vinyl dichloride, and butadiene, copolymers of vinylidene chloride with butyl acrylate and nitrite, and polymer blends of PVC with acrylonitrile-butadiene-styrene (ABS), acrylic-styrene-acrylonitrile (ASA), nitrite rubber, and polyvinyl acetate (EVA). Preferably, the chlorine-containing polymer is recycled neoprene rubber.

(14) U.S. Pat. No. 6,352,235 to Cizek.

U.S. Pat. No. 6,352,235 issued to Cizek on Mar. 5, 2002 in U.S. class 248 and subclass 692 teaches a combination bottle hook and bottle cap wrench device for suspending a plastic beverage bottle from a nearby structure and for providing a wrench mechanism for aiding the user to loosen the bottle cap of the beverage bottle. The device includes an L-shaped piece of plastic material having first and second legs extending at substantially right angles relative to one another. One leg has an open-ended C-shaped head portion for clamping around the neck of the beverage bottle. The other leg forms a retaining member for placement behind a portion of the structure on which it is desired to hook the beverage bottle. The inner surface of the C-shaped head portion is serrated or notched for purposes of gripping the bottle cap when it is desired to loosen the bottle cap.

(15) United States Patent Application Publication Number 2002/0066758 to Fadal et al.

United States Patent Application Publication Number 2002/0066758 published to Fadal et al. on Jun. 6, 2002 in U.S. class 224 and subclass 148.7 teaches a cap or closure including an integrated clip in the cap. The cap is designed to fit on standard bottle constructions. The clip may be either an integrated feature of a reconfigured cap or may be an add-on adapted to be secured to an existing cap. Alternatively, the integrated clip is part of the cap mold or an add-on clip is frictionally mounted, sonic-welded, or otherwise glued or secured to an existing cap design. The bottle container is not altered and may be manufactured, filled, labeled, and process using existing equipment. The cap is then secured to the bottle with the integral clip, or the clip can be added as a downstream step after the bottle is closed and sealed.

(16) U.S. Pat. No. 6,706,366 to Meyer et al.

U.S. Pat. No. 6,706,366 issued to Meyer et al. on Mar. 16, 2004 in U.S. class 428 and subclass 156 teaches a curved roofing tile that is formed of strong materials so that it may be fabricated in an extra-width configuration. Strengthening ridges and connector ridges are compression molded so the roofing tile forms a one-piece unit. To help the ecology, recycled materials, such as rubbers and plastics, are combined.

(17) United States Patent Application Publication Number 2004/0050815 to Blanchester.

United States Patent Application Publication Number 2004/0050815 published to Blanchester on Mar. 18, 2004 in U.S. class 215 and subclass 399 teaches a carrying device for attaching to a bottle, around a bottle neck. The carrying device has a ring segment that is received by the neck below the bottle cap and a hook segment attached to the ring segment. The ring segment is shaped as a substantially thin planar disc, and the hook segment is planar and thin. The hook segment and the ring segment extend in a common plane and are foldable along an axis line between the hook segment and the ring segment. The axis line is perpendicularly to a connection line between centers of the openings of the hook segment and the ring segment. The planar ring segment and hook segment can be folded toward each other and be secured around bottle neck by a cap. In use, the carrying device is unfolded and has the hook segment available for attachment.

(18) United States Patent Application Publication Number 2005/0198917 to Hokkirigawa et al.

United States Patent Application Publication Number 2005/0198917 published to Hokkirigawa et al. on Sep. 15, 2005 in U.S. class 52 and subclass 173.1 teaches a tile made of a fire-resistant ceramic, which is obtained by mixing and kneading defatted bran obtained from rice bran and a thermosetting resin, primarily baking the resulting mixture in an inert gas at 700° C. to 1000° C., crushing the resulting product into carbonized powder, mixing and kneading the carbonized powder with a ceramic powder, a solvent and, optionally, a binder to provide a plasticized mixture (ceramic-solvent mixture), pressure-forming the mixture at a compression pressure of 10 MPa to 100 MPa, and heat-treating the resulting compact again in an atmosphere of an inert gas at 500 to 1400° C.

(19) U.S. Pat. No. 7,062,882 to Porat.

U.S. Pat. No. 7,062,882 issued to Porat on Jun. 20, 2006 in U.S. class 52 and subclass 12 teaches a roofing tile configured to allow liquid, such as rain, to flow through the roofing tile. The roofing tile allows the design of a roof with hidden gutters.

(20) United States Patent Application Publication Number 2006/0266406 to Faust et al.

United States Patent Application Publication Number 2006/0266406 published to Faust et al. on Nov. 30, 2006 in U.S. class 136 and subclass 244 teaches an integrated solar-voltaic roof tile that is durable, consistent in color with common roofing materials, and allows for installation of a roof system that produces cost-effective electricity from solar power. The design includes an elastomeric or polymeric substrate roof tile material, an integrated solar-voltaic cell that is molded into the roof tile and appears as an integral part of the roof tile material, a protective covering material composed of coated glass or a clear polymeric material, and electrical leads and plates built into the substrate material that connect to the solar-voltaic cell, and when roof tiles are installed in a traditional fashion, the current from each solar voltaic cell flows through the roof system to a common electricity collector point from which it is flows to a induction system that coverts direct current into alternating current and from which the current flows to the house electrical system or the public electricity grid.

(21) U.S. Pat. No. 7,607,592 to Kim. U.S. Pat. No. 7,607,592 issued to Kim on Oct. 27, 2009 in U.S. class 239 and subclass 377 teaches an apparatus for accessorizing water and beverage bottles, which includes a water mister, a portable humidifier, a vitamin or nutritional supplement dispenser, and other useful accessories.

It is apparent that numerous innovations for bottle cap/bottle/cap accessories, and roof tiles and asphalt have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a multi-function carrying handle and suspender either for engaging a cap and a shoulder of a bottle simultaneously in such a manner so as to better distribute carrying load so as to avoid puncturing the shoulder of the bottle when being carried or for facilitating turning the cap of the bottle or for suspending a suspendable article.

2. SUMMARY OF THE INVENTION

Thus, an object of the embodiments of the present invention is to provide a multi-function carrying handle and suspender either for engaging a cap and a shoulder of a bottle simultaneously in such a manner so as to better distribute carrying load so as to avoid puncturing the shoulder of the bottle when being carried or for facilitating turning the cap of the bottle or for suspending a suspendable article, which avoids the disadvantages of the prior art.

Briefly stated, another object of the embodiments of the present invention is to provide a multi-function carrying handle and suspender either for engaging a cap and a shoulder of a bottle simultaneously in such a manner so as to better distribute carrying load so as to avoid puncturing the shoulder of the bottle when being carried or for facilitating turning the cap of the bottle or for suspending a suspendable article, which includes a body, an arm, and fingers. The body has a through bore engaging the cap of the bottle when used to carry the bottle or when used to facilitating turning the cap of the bottle. The arm extends arcuately outwardly from the body to a terminal end, and carries the bottle when used to carry the bottle or facilitate turning the cap of the bottle when used to facilitating turning the cap of the bottle. The fingers extend laterally outwardly from the terminal end of the arm, from a longitudinal axis of lateral symmetry of the arm, and engage the shoulder of the bottle in such a manner so as to better distribute the carrying load so as to avoid puncturing the shoulder of the bottle when used to carry the bottle.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

Figure 7:
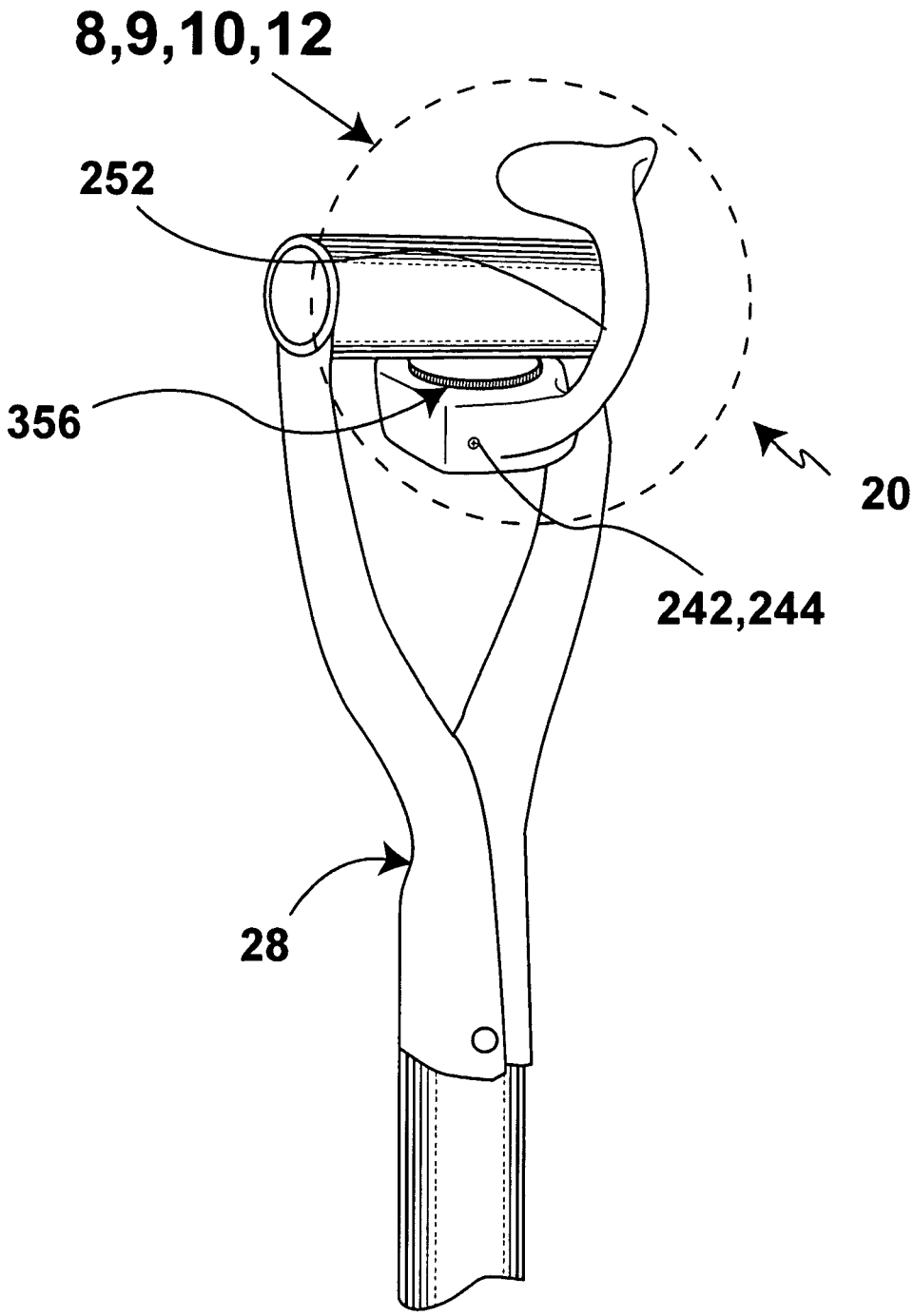
FIG. 7 is an enlarged diagrammatic perspective view of the area generally enclosed by the dotted curve identified by ARROW 7 in FIG. 6.
Figure 12:
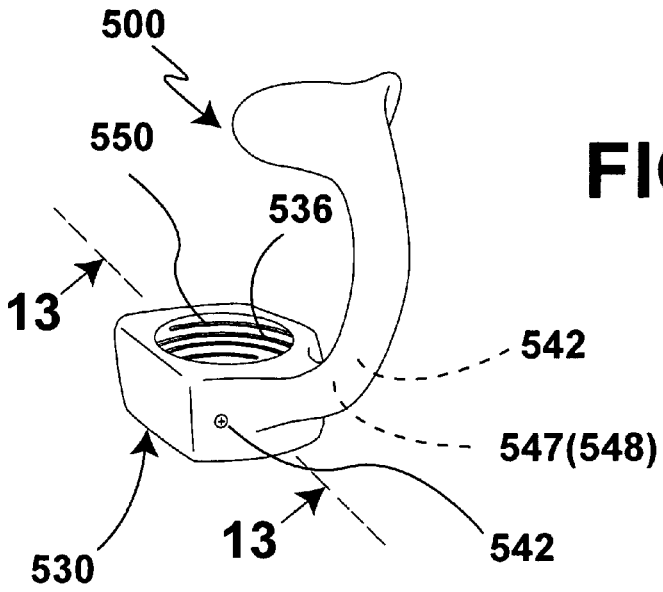
Figure 13:
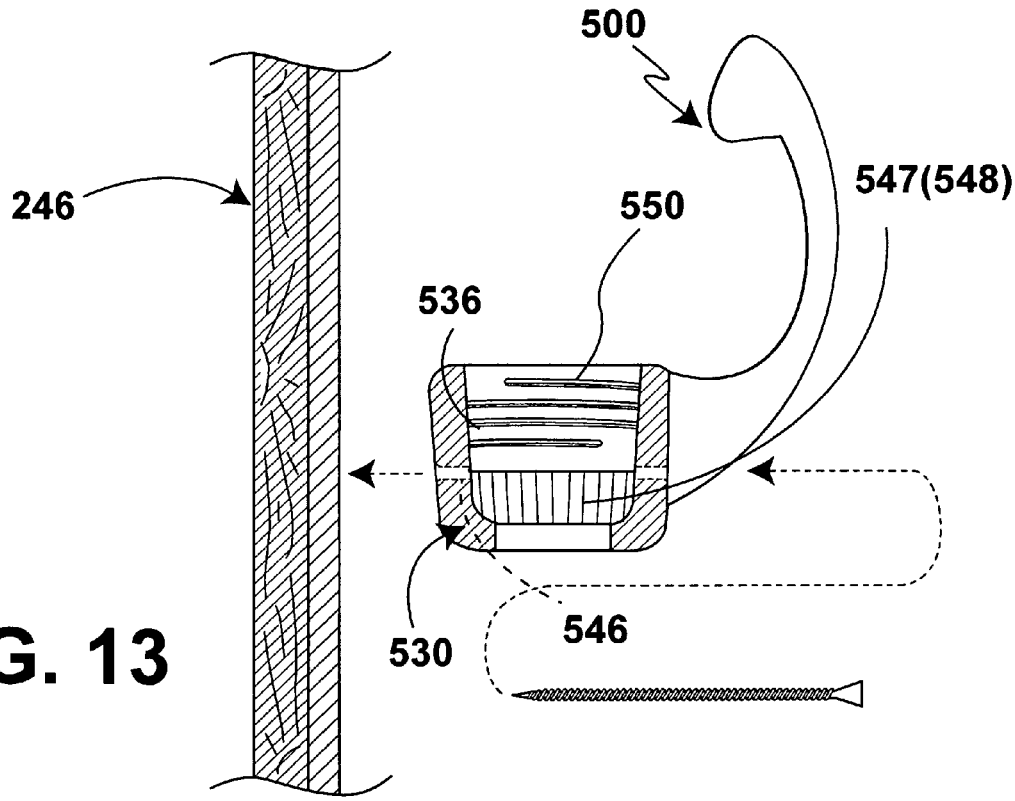

FIG. 12 is an enlarged diagrammatic perspective view of the area generally enclosed by the dotted curve identified by ARROW 12 in FIG. 7 of a fourth embodiment of the multi-function carrying handle and suspender of the present invention; and FIG. 13 is an enlarged diagrammatic cross sectional view taken along LINE 12-12 in FIG. 12 of the fourth embodiment of the multi-function carrying handle and suspender of the present invention.

4. LIST OF REFERENCE NUMERALS UTILIZED IN THE FIGURES OF THE DRAWING

A. General

20 multi-function carrying handle and suspender of embodiments of present invention either for engaging cap 22 and shoulder 24 of bottle 26 simultaneously in such manner so as to better distribute carrying load so as to avoid puncturing shoulder 24 of bottle 26 when being carried or for facilitating turning cap 22 of bottle 26 or for suspending suspendable article 28

22 cap of bottle 26

24 shoulder of bottle

26 bottle

28 suspendable article

30 squeeze spout of cap 22 of bottle 26

B. Configuration of First Embodiment of Multi-Function Carrying Handle and Suspender 200

200 multi-function carrying handle and suspender of embodiments of present invention either for engaging cap 22 and shoulder 24 of bottle 26 simultaneously in such manner so as to better distribute carrying load so as to avoid puncturing shoulder 24 of bottle 26 when being carried or for facilitating turning cap 22 of bottle 26 or for suspending suspendable article 28

230 body

232 arm for carrying bottle 26 when multi-function carrying handle and suspender 200 is being used to carry bottle 26 or is for facilitating turning cap 22 of bottle 26 when multi-function carrying handle and suspender 200 is being used to facilitate turning cap 22 of bottle 26

234 fingers for engaging shoulder 24 of bottle 26 in such a manner so as to better distribute carrying load so as to avoid puncturing shoulder 24 of bottle 26 when multi-function carrying handle and suspender 200 is being used to carry bottle 26

236 through bore in body 230 for engaging cap 22 of bottle 26 when multi-function carrying handle and suspender 200 is being used to carry bottle 26 or when multi-function carrying handle and suspender 200 is being used to facilitate turning cap 22 of bottle 26

238 terminal end of arm 232

240 longitudinal axis of lateral symmetry of arm 232

242 pair of through bores in body 230 for receiving pair of screws 244 for attaching multi-function carrying handle and suspender 200 to wall 246 when multi-function carrying handle and suspender 200 is being used to suspend article 28

244 pair of screws

246 wall

247 peripheral wall defining through bore 236 in body 230

248 vertically-oriented serrations of peripheral wall 247 defining through bore 236 in body 230 for frictionally engaging vertical serrations on cap 22 of bottle 26 for more better gripping cap 22 of bottle 26

249 sides of body 230

250 rounded edges of body 230 for protecting hand of user

252 comfortable and ergonomic handle of arm 232 for carrying bottle 26 when multi-function carrying handle and suspender 200 is being used to carry bottle 26 or for facilitating turning cap 22 of bottle 26 when multi-function carrying handle and suspender 200 is being used to facilitate turning cap 22 of bottle 26 or for suspending suspendable article 28 therefrom when multi-function carrying handle and suspender 200 is being used to suspend suspendable article 28

254 pair of arcuate wings of fingers 234 for more better conformingly engaging shoulder 24 of bottle 26 in such a manner so as to better distribute carrying load so as to avoid puncturing shoulder 24 of bottle 26 when multi-function carrying handle and suspender 200 is being used to carry bottle 26

C. Configuration of Second Embodiment of Multi-Function Carrying Handle and Suspender 300

300 multi-function carrying handle and suspender of embodiments of present invention either for engaging cap 22 and shoulder 24 of bottle 26 simultaneously in such manner so as to better distribute carrying load so as to avoid puncturing shoulder 24 of bottle 26 when being carried or for facilitating turning cap 22 of bottle 26 or for suspending suspendable article 28

330 body

336 through bore in the body 330

356 disk

358 circular periphery of disk 356

360 vertically-oriented serrations of circular periphery 358 of disk 356 for frictionally engaging vertically-oriented serrations 348 of peripheral wall 347 defining through bore 336 in body 330 for more better having disk 356 grip in body 330

D. Configuration of Third Embodiment of Multi-Function Carrying Handle and Suspender 400

400 multi-function carrying handle and suspender of embodiments of present invention either for engaging cap 22 and shoulder 24 of bottle 26 simultaneously in such manner so as to better distribute carrying load so as to avoid puncturing shoulder 24 of bottle 26 when being carried or for facilitating turning cap 22 of bottle 26 or for suspending suspendable article 28

430 body

442 pair of through bores in body 430

E. Configuration of Fourth Embodiment of Multi-Function Carrying Handle and Suspender 500

500 multi-function carrying handle and suspender of embodiments of present invention either for engaging cap 22 and shoulder 24 of bottle 26 simultaneously in such manner so as to better distribute carrying load so as to avoid puncturing shoulder 24 of bottle 26 when being carried or for facilitating turning cap 22 of bottle 26 or for suspending suspendable article 28

530 body

536 through bore in body 530

547 peripheral wall defining through bore 536 in body 530

548 vertically-oriented serrations of peripheral wall 547 defining through bore 536 in body 530

550 threads for use when multi-function carrying handle and suspender 500 is being attached to threaded neck of bottle 26

5. DETAILED DESCRIPTION OF THE PREFERRED EMBODIMENTS

A. General

Figure 1:
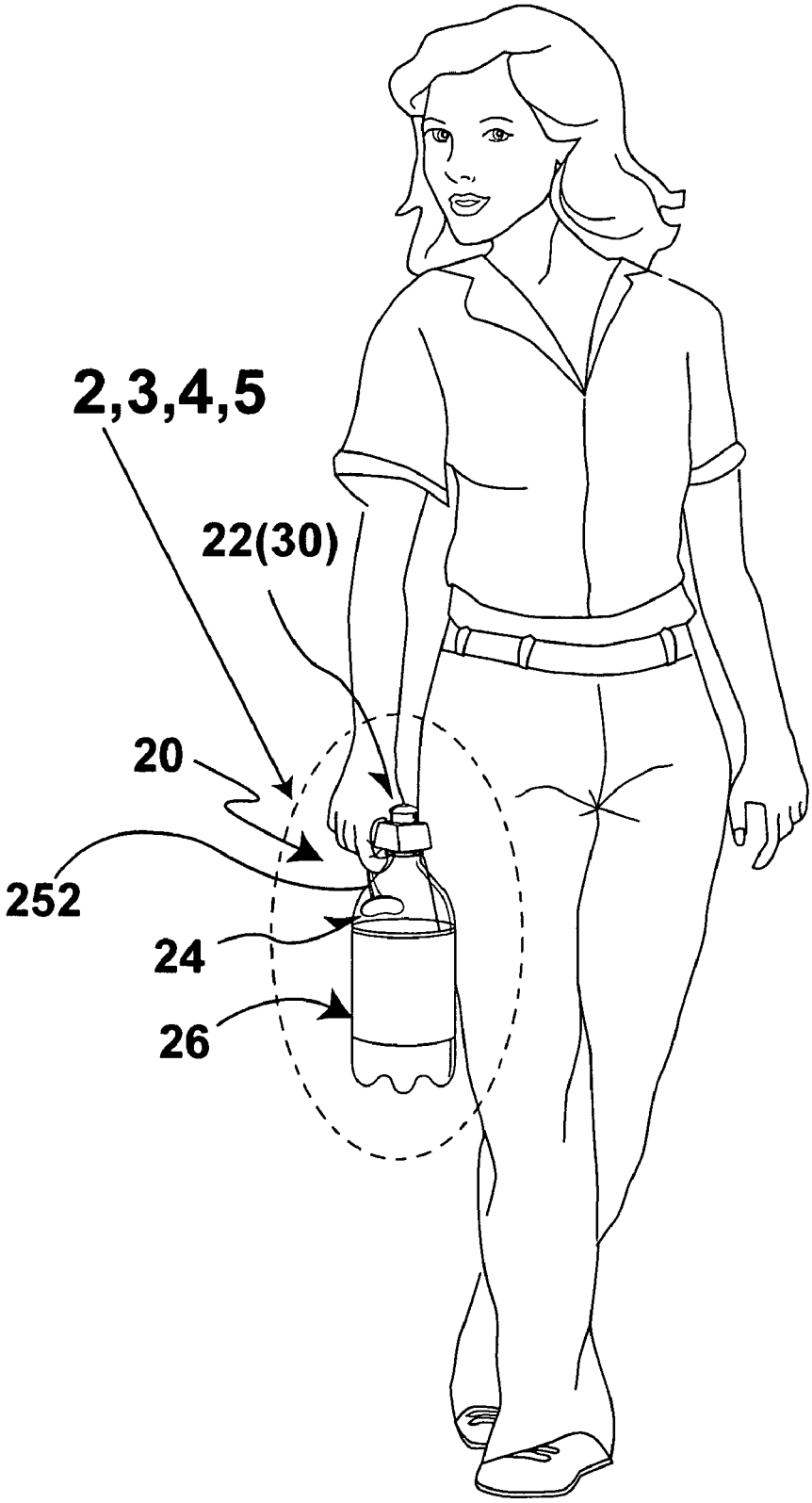
FIG. 1 is a diagrammatic perspective view of the multi-function carrying handle and suspender of the embodiments of the present invention engaging a cap and a shoulder of a bottle simultaneously in such a manner so as to better distribute carrying load so as to avoid puncturing the shoulder of the bottle when being carried and facilitating turning the cap of the bottle.
Figure 2:
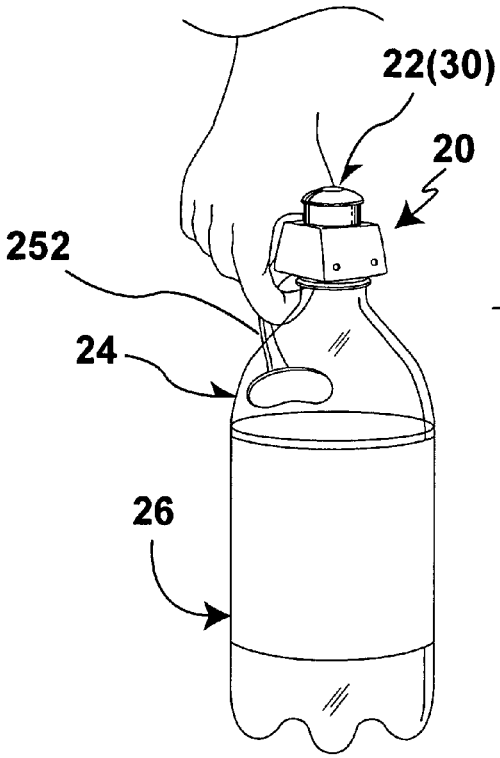
FIG. 2 is an enlarged diagrammatic perspective view of the area generally enclosed by the dotted curve identified by ARROW 2 in FIG. 1.
Figure 3:
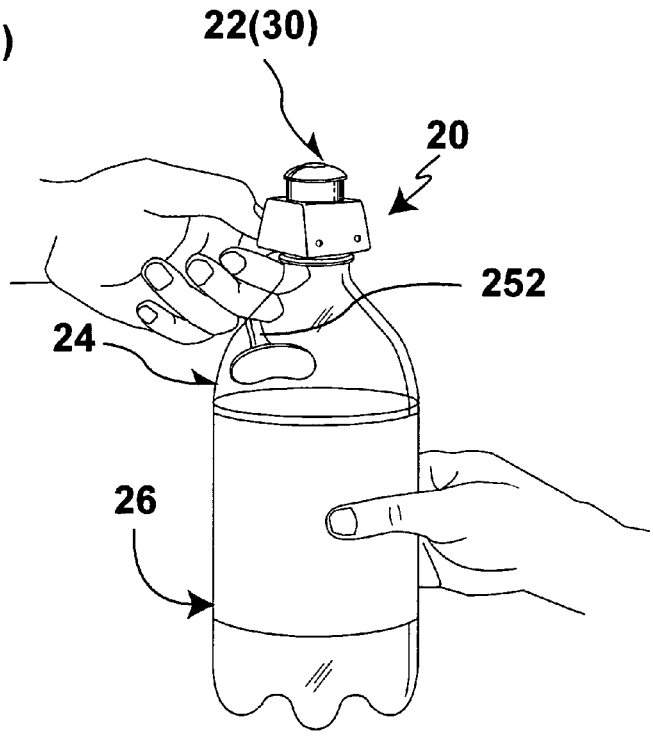
FIG. 3 is an enlarged diagrammatic perspective view of the area generally enclosed by the dotted curve identified by ARROW 3 in FIG. 1.
Figure 4:
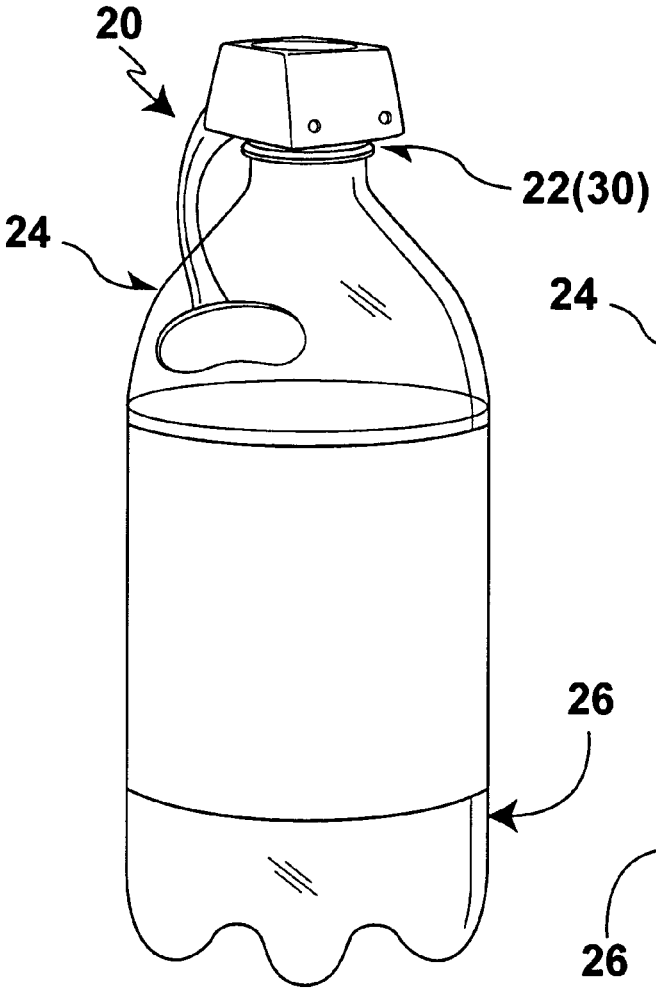
FIG. 4 is an enlarged diagrammatic perspective view of the area generally enclosed by the dotted curve identified by ARROW 5 in FIG. 1.
Figure 5:
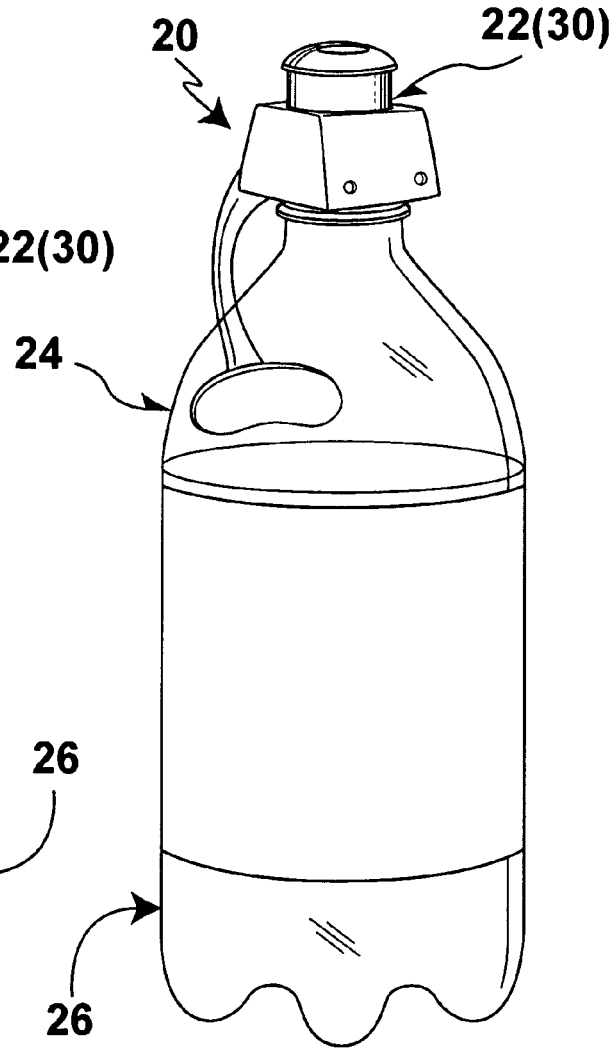
FIG. 5 is an enlarged diagrammatic perspective view of the area generally enclosed by the dotted curve identified by ARROW 5 in FIG. 1.
Figure 6:
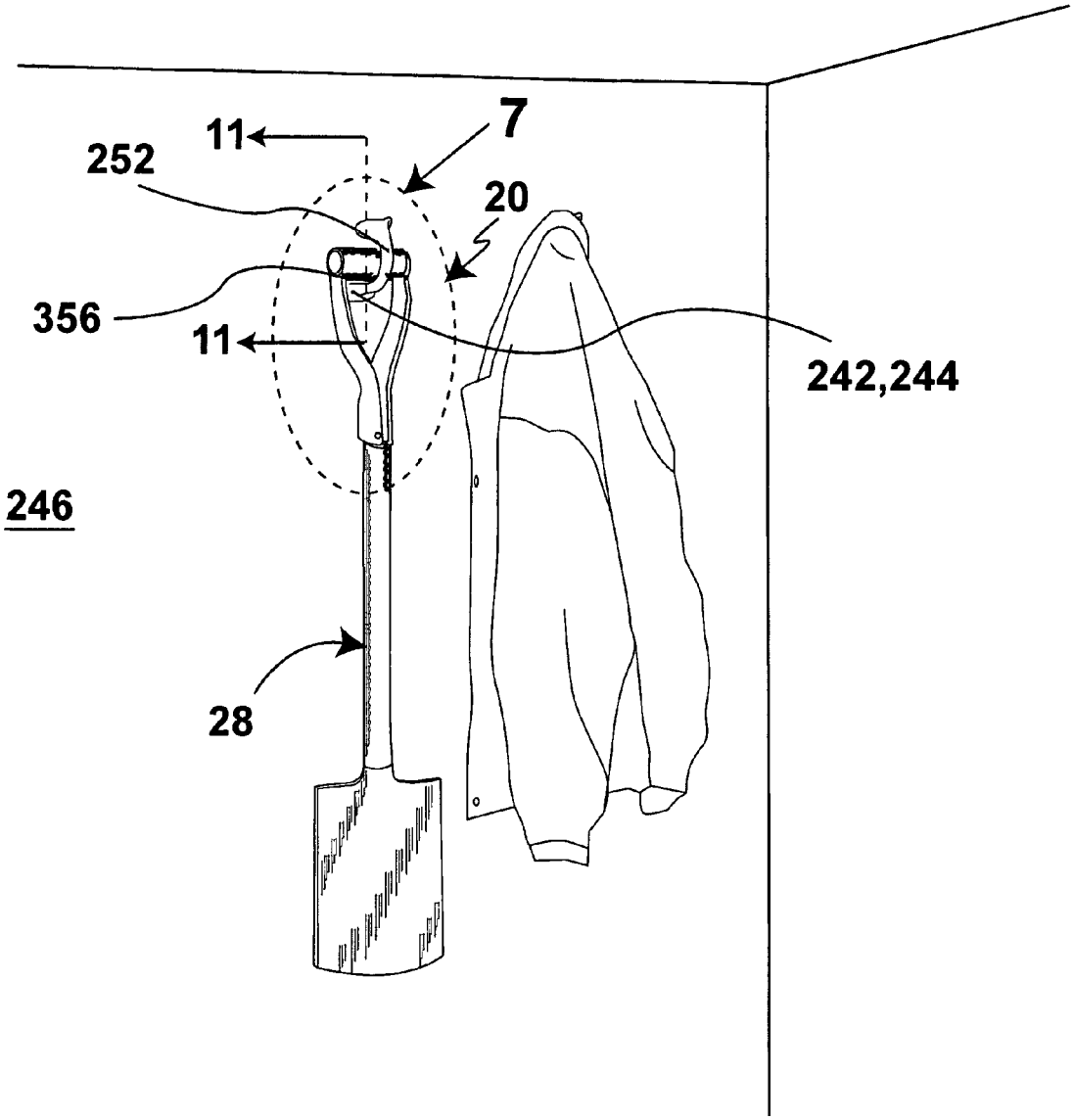
FIG. 6 is a diagrammatic perspective view of the multi-function carrying handle and suspender of the embodiments of the present invention suspending a suspendable article.

Referring now to the figures, in which like numerals indicate like parts, and particularly to FIGS. 1-7, which are, respectively, a diagrammatic perspective view of the multi-function carrying handle and suspender of the embodiments of the present invention engaging a cap and a shoulder of a bottle simultaneously in such a manner so as to better distribute carrying load so as to avoid puncturing the shoulder of the bottle when being carried and facilitating turning the cap of the bottle, an enlarged diagrammatic perspective view of the area generally enclosed by the dotted curve identified by ARROW 2 in FIG. 1, an enlarged diagrammatic perspective view of the area generally enclosed by the dotted curve identified by ARROW 3 in FIG. 1, an enlarged diagrammatic perspective view of the area generally enclosed by the dotted curve identified by ARROW 5 in FIG. 1, an enlarged diagrammatic perspective view of the area generally enclosed by the dotted curve identified by ARROW 5 in FIG. 1, a diagrammatic perspective view of the multi-function carrying handle and suspender of the embodiments of the present invention suspending a suspendable article, and an enlarged diagrammatic perspective view of the area generally enclosed by the dotted curve identified by ARROW 7 in FIG. 6, the multi-function carrying handle and suspender of the embodiments of the present invention is shown generally at 20 either for engaging a cap 22 and a shoulder 24 of a bottle 26 simultaneously in such a manner so as to better distribute carrying load so as to avoid puncturing the shoulder 24 of the bottle 26 when being carried (FIGS. 1-5) or for facilitating turning the cap 22 of the bottle 26 (FIGS. 1-5, particularly, FIG. 3) or for suspending a suspendable article 28 therefrom (FIGS. 6 and 7).

B. Configuration of a First Embodiment of the Multi-Function Carrying Handle and Suspender 200

Figure 8:
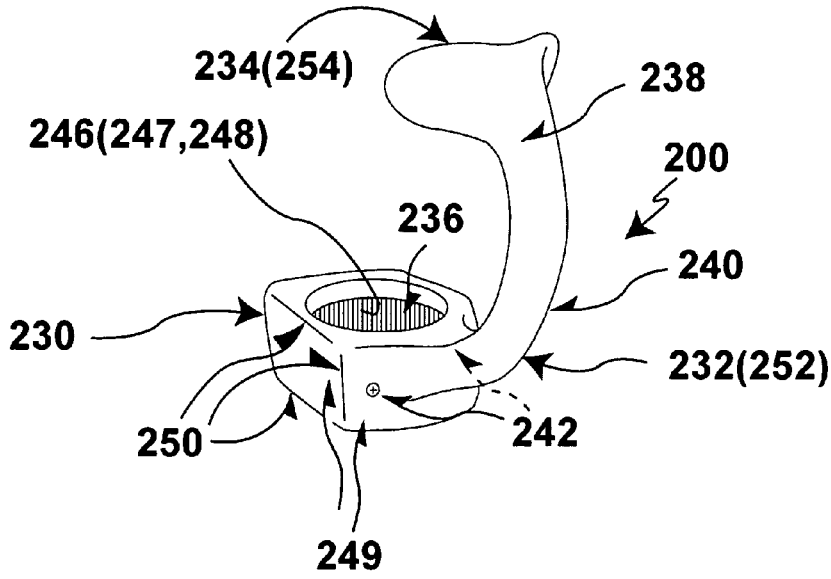
FIG. 8 is an enlarged diagrammatic perspective view of the area generally enclosed by the dotted curve identified by ARROW 8 in FIG. 7 of a first embodiment of the multi-function carrying handle and suspender of the present invention.

The configuration of a first embodiment of the multi-function carrying handle and suspender 200 can best be seen in FIG. 8, which is an enlarged diagrammatic perspective view of the area generally enclosed by the dotted curve identified by ARROW 8 in FIG. 7 of a first embodiment of the multi-function carrying handle and suspender of the present invention, and as such, will be discussed with reference thereto.

The multi-function carrying handle and suspender 200 comprises a body 230, an arm 232, and fingers 234.

The body 230 has a through bore 236 extending axially therethrough. The through bore 236 in the body 230 is for engaging the cap 22 of the bottle 26 when the multi-function carrying handle and suspender 200 is being used to carry the bottle 26, and when the cap 22 of the bottle 26 is a squeeze spout 30, the through bore 236 in the body 230 allows access to, and extension of and retraction of, the squeeze spout 30 of the cap 22 of the bottle 26 (FIGS. 1-5), or when the multi-function carrying handle and suspender 200 is being used to facilitating turning the cap 22 of the bottle 26.

The arm 232 extends arcuately outwardly from the body 230 to a terminal end 238, has a longitudinal axis of lateral symmetry 240, and is for carrying the bottle 26 when the multi-function carrying handle and suspender 200 is being used to carry the bottle 26 or is for facilitating turning the cap 22 of the bottle 26 when the multi-function carrying handle and suspender 200 is being used to facilitate turning the cap 22 of the bottle 26. The fingers 234 extend laterally outwardly from the terminal end 238 of the arm 232, from the longitudinal axis of lateral symmetry 240 of the arm 232, and are for engaging the shoulder 24 of the bottle 26 in such a manner so as to better distribute the carrying load so as to avoid puncturing the shoulder 24 of the bottle 26 when the multi-function carrying handle and suspender 200 is being used to carry the bottle 26.

The body 230 further has a pair of through bores 242 extending laterally therethrough. The pair of through bores 242 in the body 230 straddle the through bore 236 in the body 230, and are for receiving a pair of screws 244 for attaching the multi-function carrying handle and suspender 200 to a wall 246 when the multi-function carrying handle and suspender 200 is being used to suspend the article 28 therefrom (FIGS. 6 and 7).

The through bore 236 in the body 230 is vertically oriented, is generally somewhat cylindrically shaped for more better conformingly receiving the cap 22 of the bottle 26, and is defined by a peripheral wall 247. The peripheral wall 247 defining the through bore 236 in the body 230 has vertically-oriented serrations 248 therearound. The vertically-oriented serrations 248 of the peripheral wall 247 defining the through bore 236 in the body 230 are for frictionally engaging vertical serrations on the cap 22 of the bottle 26 for more better gripping the cap 22 of the bottle 26.

The body 230 is generally cubically shaped, and has sides 249 and rounded edges 250 for protecting a hand of a user.

The arm 232 extends arcuately and vertically outwardly from a side 249 of the body 230 to the terminal end 238 of the arm 232 so as to form a comfortable and ergonomic handle 252 for carrying the bottle 26 when the multi-function carrying handle and suspender 200 is being used to carry the bottle 26 (FIGS. 1 and 2) or for facilitating turning the cap 22 of the bottle 26 when the multi-function carrying handle and suspender 200 is being used to facilitate turning the cap 22 of the bottle 26 (FIG. 3) or for suspending the suspendable article 28 therefrom when the multi-function carrying handle and suspender 200 is being used to suspend the suspendable article 28.

The fingers 234 extend laterally outwardly from the terminal end 238 of the arm 232, from both sides of the longitudinal axis of lateral symmetry 240 of the arm 232, respectively, into a pair of arcuate wings 254. The pair of arcuate wings 254 of the fingers 234 has contours for more better conformingly engaging the shoulder 24 of the bottle 26 in such a manner so as to better distribute the carrying load so as to avoid puncturing the shoulder 24 of the bottle 26 when the multi-function carrying handle and suspender 200 is being used to carry the bottle 26.

C. Configuration of a Second Embodiment of the Multi-Function Carrying Handle and Suspender 300

Figure 9:
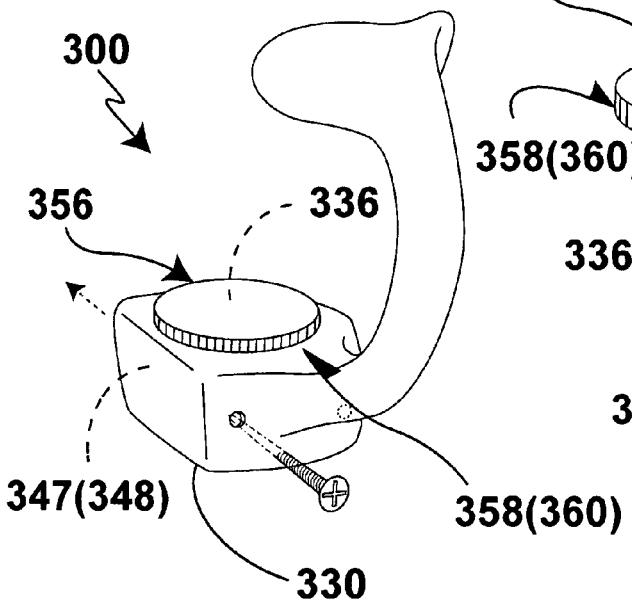
FIG. 9 is an enlarged diagrammatic perspective view of the area generally enclosed by the dotted curve identified by ARROW 9 in FIG. 7 of a second embodiment of the multi-function carrying handle and suspender of the present invention.
Figure 10:
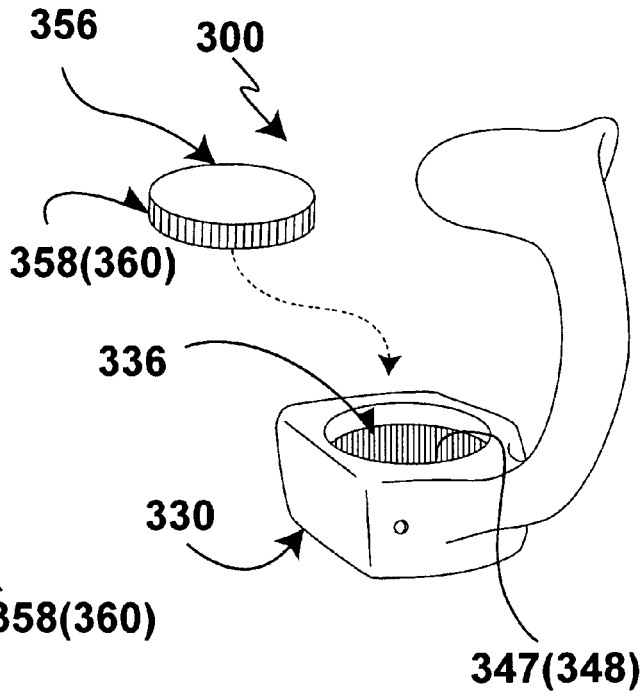
FIG. 10 is an enlarged and exploded diagrammatic perspective view of the area generally enclosed by the dotted curve identified by ARROW 10 in FIG. 7 of the second embodiment the multi-function carrying handle and suspender of the present invention.

The configuration of the multi-function carrying handle and suspender 300 can best be seen in FIGS. 9 and 10, which are, respectively, an enlarged diagrammatic perspective view of the area generally enclosed by the dotted curve identified by ARROW 9 in FIG. 7 of a second embodiment of the multi-function carrying handle and suspender of the present invention, and an enlarged and exploded diagrammatic perspective view of the area generally enclosed by the dotted curve identified by ARROW 10 in FIG. 7 of the second embodiment the multi-function carrying handle and suspender of the present invention, and as such, will be discussed with reference thereto. The multi-function carrying handle and suspender 300 is similar to the multi-function carrying handle and suspender 200, except for the addition of a disk 356.

The disk 356 is sized and shaped to fit snugly and partially in and partially out of the through bore 336 in the body 330 so as to close the through bore 336 in, and strengthen, the body 330 when the multi-function carrying handle and suspender 300 is being used to suspend the suspendable article 28 therefrom (FIGS. 6 and 7).

The disk 356 has a circular periphery 358. The circular periphery 358 of the disk 356 has vertically-oriented serrations 360 therearound. The vertically-oriented serrations 360 of the circular periphery 358 of the disk 356 are for frictionally engaging the vertically-oriented serrations 348 of the peripheral wall 347 defining the through bore 336 in the body 330 for more better having the disk 356 grip in the body 330.

D. Configuration of a Third Embodiment of the Multi-Function Carrying Handle and Suspender 400

Figure 11:
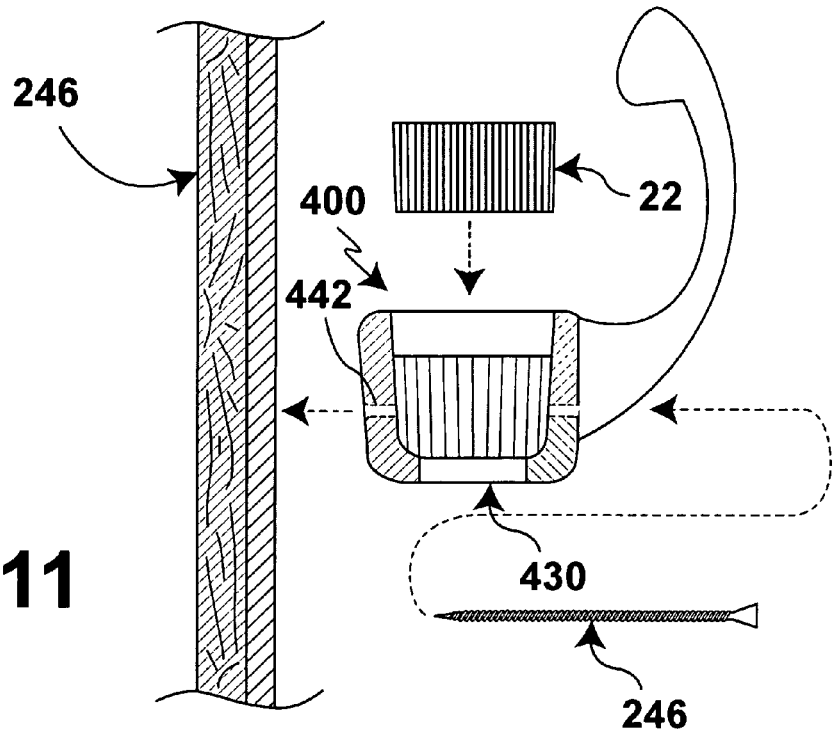
FIG. 11 is an enlarged diagrammatic cross sectional view taken along LINE 11-11 in FIG. 6 of a third embodiment of the multi-function carrying handle and suspender of the present invention.

The configuration of the multi-function carrying handle and suspender 400 can best be seen in FIG. 11, which is an enlarged diagrammatic cross sectional view taken along LINE 11-11 in FIG. 6 of a third embodiment of the multi-function carrying handle and suspender of the present invention, and as such, will be discussed with reference thereto.

The multi-function carrying handle and suspender 400 is similar to the multi-function carrying handle and suspender 300, except that the disk 356 is replaced by the cap 22 of the bottle 26.

The multi-function carrying handle and suspender 400 is attached to the wall 246 by the pair of screws 244 passing through the pair of through bores 442 in the body 430 and into the wall 246 when the multi-function carrying handle and suspender 400 is being used to suspend the article 28 therefrom.

E. Configuration of a Fourth Embodiment of the Multi-Function Carrying Handle and Suspender 500

The configuration of a fourth embodiment of the multi-function carrying handle and suspender 500 can best be seen in FIGS. 12 and 13, which are, respectively, an enlarged diagrammatic perspective view of the area generally enclosed by the dotted curve identified by ARROW 12 in FIG. 7 of a fourth embodiment of the multi-function carrying handle and suspender of the present invention, and an enlarged diagrammatic cross sectional view taken along LINE 12-12 in FIG. 12 of the fourth embodiment of the multi-function carrying handle and suspender of the present invention, and as such, will be discussed with reference thereto.

The multi-function carrying handle and suspender 500 is similar to the multi-function carrying handle and suspender 200, except that at least a portion of the vertically-oriented serrations 548 of the peripheral wall 547 defining the through bore 536 in the body 530 is replaced by threads 550 for use when the multi-function carrying handle and suspender 500 is being attached to a threaded neck of the bottle 26.

The multi-function carrying handle and suspender 500 is attached to the wall 246 by the pair of screws 244 passing through the pair of through bores 542 in the body 530 and into the wall 246 when the multi-function carrying handle and suspender 500 is being used to suspend the article 28.

F. Impressions

It will be understood that each of the elements described above or two or more together may also find a useful application in other types of constructions differing from the types described above.

While the embodiments of the present invention have been illustrated and described as embodied in a multi-function carrying handle and suspender either for engaging a cap and a shoulder of a bottle simultaneously in such a manner so as to better distribute carrying load so as to avoid puncturing the shoulder of the bottle when being carried or for facilitating turning the cap of the bottle or for suspending a suspendable article, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A multi-function carrying handle and suspender either for engaging a cap and a shoulder of a bottle simultaneously in such a manner so as to better distribute carrying load so as to avoid puncturing the shoulder of the bottle when being carried or for facilitating turning the cap of the bottle or for suspending a suspendable article therefrom, comprising:

a) a body;

b) an arm; and c) fingers;

wherein said body has a through bore extending axially therethrough;

wherein said through bore in said body is for engaging the cap of the bottle when said multi-function carrying handle and suspender is being used to carry the bottle or when said multi-function carrying handle and suspender is being used to facilitate turning the cap of the bottle; said body further has a pair of through bores extending laterally therethrough for receiving a pair of screws for attaching said multi-function carrying handle and suspender to a wall when said multi-function carrying handle and suspender is being used to suspend the article therefrom;

wherein said arm extends arcuately outwardly from said body to a terminal end;

wherein said arm has a longitudinal axis of lateral symmetry;

wherein said arm is for carrying the bottle when said multi-function carrying handle and suspender is being used to carry the bottle or for facilitating turning the cap of the bottle when said multi-function carrying handle and suspender is being used to facilitate turning the cap of the bottle;

wherein said fingers extend laterally outwardly from said terminal end of said arm, from said longitudinal axis of lateral symmetry of said arm; and wherein said fingers are for engaging the shoulder of the bottle in such a manner so as to better distribute the carrying load so as to avoid puncturing the shoulder of the bottle when said multi-function carrying handle and suspender is being used to carry the bottle.

2. The multi-function carrying handle and suspender of claim 1, wherein said pair of through bores in said body straddle said through bore in said body.

3. The multi-function carrying handle and suspender of claim 1, wherein said through bore in said body is vertically oriented; and wherein said through bore in said body is generally somewhat cylindrically shaped for more better conformingly receiving the cap of the bottle.

4. The multi-function carrying handle and suspender of claim 1, wherein said through bore in said body is defined by a peripheral wall;

wherein said peripheral wall defining said through bore in said body has at least one of vertically-oriented serrations and threads therearound; and wherein said vertically-oriented serrations of said peripheral wall defining said through bore in said body are frictionally engageable with vertical serrations on the cap of the bottle for more better gripping the cap of the bottle.

5. The multi-function carrying handle and suspender of claim 4, further comprising a disk, wherein said disk is sized and shaped to fit snugly, and partially in and partially out, of said through bore in said body so as to close said through bore in, and strengthen, said body when said multi-function carrying handle and suspender is being used to suspend the suspendable article therefrom.

6. The multi-function carrying handle and suspender of claim 4, further comprising a disk, wherein said disk has a circular periphery;

wherein said circular periphery of said disk has vertically-oriented serrations therearound; and wherein said vertically-oriented serrations of said circular periphery of said disk frictionally engage said vertically-oriented serrations of said peripheral wall defining said through bore in said body for more better having said disk grip in said body.

7. The multi-function carrying handle and suspender of claim 4, further comprising said cap of the bottle; and wherein said vertically-oriented serrations of said peripheral wall defining said through bore in said body frictionally engage vertical serrations on said cap of the bottle for more better gripping said cap of the bottle.

8. The multi-function carrying handle and suspender of claim 4, wherein at least a portion of said through bore in said body has the threads for use when said multi-function carrying handle and suspender is being attached to a threaded neck of the bottle.

9. The multi-function carrying handle and suspender of claim 1, wherein said body is generally cubically shaped; and wherein said body has sides.

10. The multi-function carrying handle and suspender of claim 1, wherein said body has rounded edges for protecting a hand of a user.

11. The multi-function carrying handle and suspender of claim 1, wherein said arm extends arcuately and vertically outwardly from a side of said body to said terminal end of said arm so as to form a comfortable and ergonomic handle for carrying the bottle when said multi-function carrying handle and suspender is being used to carry the bottle or for facilitating turning the cap of the bottle when said multi-function carrying handle and suspender is being used to facilitate turning the cap of the bottle or for suspending the suspendable article therefrom when said multi-function carrying handle and suspender is being used to suspend the suspendable article.

12. The multi-function carrying handle and suspender of claim 1, wherein said fingers extend laterally outwardly from said terminal end of said arm, from both sides of said longitudinal axis of lateral symmetry of said arm, respectively, forming a pair of arcuate wings.

13. The multi-function carrying handle and suspender of claim 12, wherein said pair of arcuate wings of said fingers has contours for more better conformingly engaging the shoulder of the bottle in such a manner so as to better distribute the carrying load so as to avoid puncturing the shoulder of the bottle when said multi-function carrying handle and suspender is being used to carry the bottle.

* * * * *